US005405306A

United States Patent [19]

Goldsmith et al.

[11] Patent Number: 5,405,306

[45] Date of Patent: Apr. 11, 1995

[54] STRETCHING APPARATUS

[76] Inventors: Daniel S. Goldsmith, 1883 Chipping Way; Walter J. Goldsmith, 1867 Golf Ridge; Michael P. Howell, 4740 Stoneleigh, all of Bloomfield Hills, Mich. 48302

[21] Appl. No.: 201,904

[22] Filed: Feb. 25, 1994

[51] Int. Cl.[6] ..... A63B 21/018

[52] U.S. Cl. ..... 482/120; 482/114; 482/907; 482/142; 482/110; 482/38

[58] Field of Search ..... 482/907, 142, 110, 114, 482/115, 120, 131, 133, 38; 606/241; 602/34

[56] References Cited

U.S. PATENT DOCUMENTS

| | | | |
|---|---|---|---|
| 3,117,782 | 1/1964 | Johnston . | |
| 4,257,592 | 3/1981 | Jones . | |
| 4,277,062 | 7/1981 | Lawrence | 482/131 |
| 4,696,470 | 9/1987 | Fenner | 482/142 |
| 4,988,096 | 1/1991 | Jones | 482/907 |
| 5,067,709 | 11/1991 | Christianson . | |
| 5,160,305 | 11/1992 | Lin | 482/142 |
| 5,261,865 | 11/1993 | Trainor . | |

*Primary Examiner*—Richard J. Apley
*Assistant Examiner*—Lynne A. Reichard
*Attorney, Agent, or Firm*—Gifford, Krass, Groh, Sprinkle, Patmore, Anderson & Citkowski

[57] ABSTRACT

An apparatus is disclosed for stretching tendons, muscles and associated soft tissues of human joints. The apparatus includes a generality planar frame having two sides, two ends, a lower surface adapted to be supported by a ground support surface and an upper surface. An elongated upright support has a first end which is secured to the frame so that the second end of the upright support extends generally vertically upwardly from the frame. At least one pulley is secured adjacent the upper end of the upright support. Thereafter, an elongated cord has one end adapted to be secured to the limb of a human user and this cord extends through the pulley. The human user, by pulling on the cord, stretches the limb of the human user in the desired fashion. By attaching the cord to different limbs and assuming different positions, the human user can stretch his or her tendons, muscles and associated soft tissues of numerous joints and a numerous stretching positions.

16 Claims, 6 Drawing Sheets

STRETCHING APPARATUS

BACKGROUND OF THE INVENTION

I. Field of the Invention

The present invention relates to an apparatus for stretching tendons, muscles and associated soft tissues of human joints.

II. Description of the Prior Art

It is well known that stretching tendons, muscles and associated soft tissues of human joints prior to and subsequent to exercise is advantageous in a number of different respects. Such stretching not only lengthens the tendons, muscles and associated soft tissue thus achieving greater flexibility, but also reduces the risk of injury to the joints during the succeeding exercise.

To date, however, there have been few devices that are devoted to stretching of tendons, muscles and associated soft tissue and these devices are limited both in their application and use. For example, one previously known stretching device has been known for stretching the inside thigh muscles of a human. This device, however, is incapable of stretching the other joints and muscle groups of the human body.

SUMMARY OF THE PRESENT INVENTION

The present invention provides an apparatus for stretching tendons, muscles and associated soft tissues of human joints which overcomes all of the above mentioned disadvantages of the previously devices.

In brief, the device of the present invention comprises a generally planar frame having two sides, two ends, a lower surface adapted to :be supported by a ground support surface and an upper surface. An elongated upright support has a lower end secured to the frame so that the upright support extends generally vertically upwardly from the top surface of the frame. Furthermore, this upright support is preferably pivotally mounted to the frame and moveable between an upper upright position and a lower collapsed position for storage.

At least one pulley, and preferably two pulleys, are secured to the upper end of the upright support. A cord then extends through the pulley. One end of the cord is adapted to be removably secured to a limb of the user while the opposite end of the cord is adapted to be pulled by the arms of the user. Thus, by pulling the second end of the cord, the user can bend and stretch the limb attached to the opposite end of the cord in the desired fashion.

In the preferred embodiment of the invention, the cord also extends through an automatic, but releasable, lock. This lock is capable of maintaining a cord in the adjusted position, e.g. with the limb in a stretch condition, for any period of time desired by the user. When stretching is no longer desired, the user releases the lock and terminates the stretching routine.

A pair of lateral supports are also preferably removably secured to the frame so that the lateral supports extend laterally outwardly from opposite sides of the frame. A pulley is secured to the outer or distal end of each lateral support. Thus, by securing one end of the cord to the users limb and threading the cord through the pulley secured to the lateral supports, lateral stretching operations can also be performed.

Still further advantages of the present invention will be hereinafter described in greater detail.

BRIEF DESCRIPTION OF THE DRAWING

A better understanding of the present invention will be had upon reference to the following detailed description when read in conjunction with the accompany drawing, wherein like reference characters refer to like parts throughout the several views, and in which.

DETAILED DESCRIPTION OF A PREFERRED EMBODIMENT OF THE PRESENT INVENTION

Figure 1:
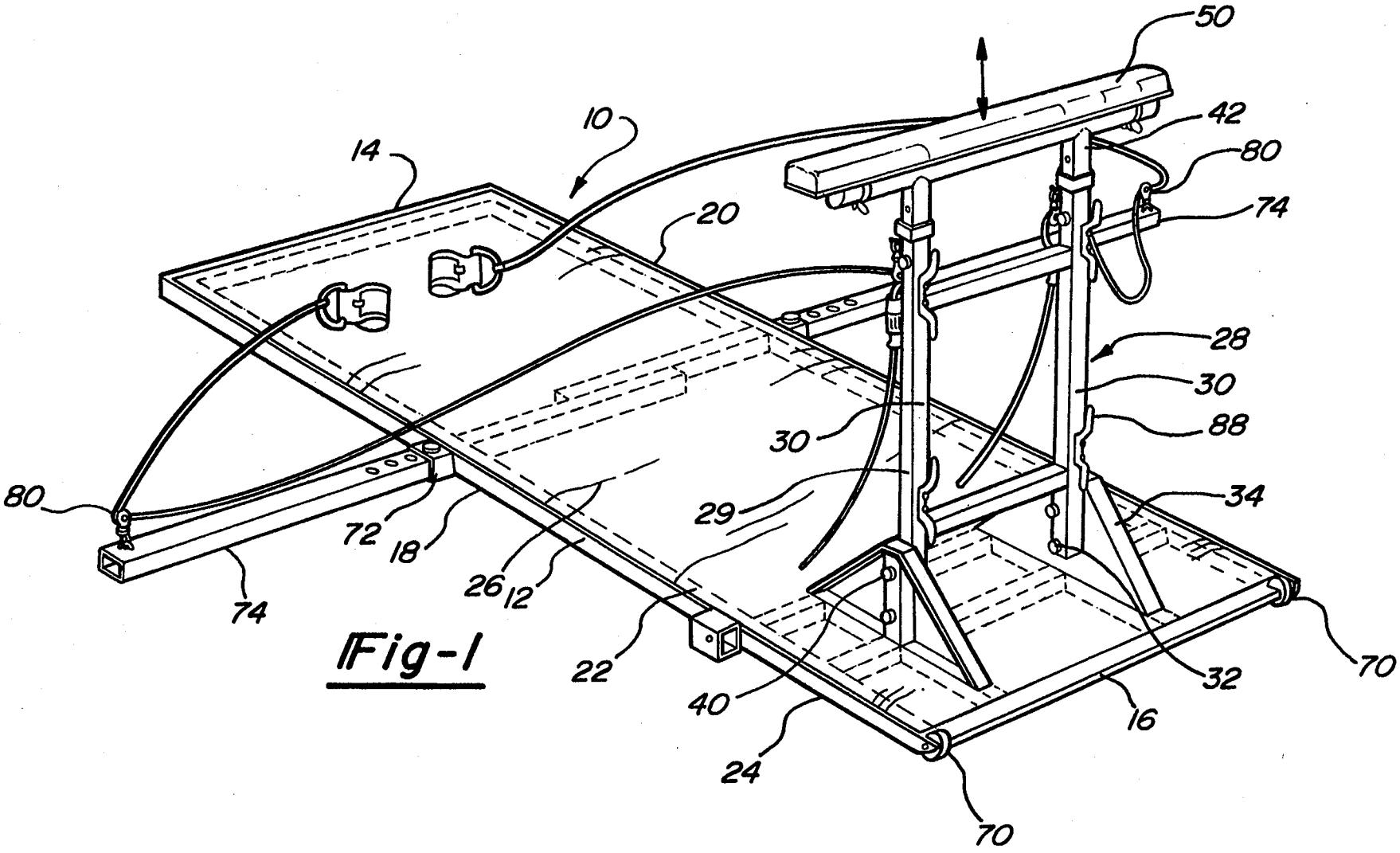
FIG. 1 is an elevational view illustrating a preferred embodiment of the present invention.

Detailed description of a preferred embodiment of the stretching apparatus 10 of the present invention is thereshown and comprises a generally rectangular and planar frame 12 The frame 12 includes two ends 14 and 16, two sides 18 and 20, an upper surface 22 and a lower surface 24 which is adapted to be supported by a ground support surface. The frame 12, furthermore, is preferably constructed from square metal tubing and the top surface 22 of the frame is covered by a pad 26.

Figure 6:
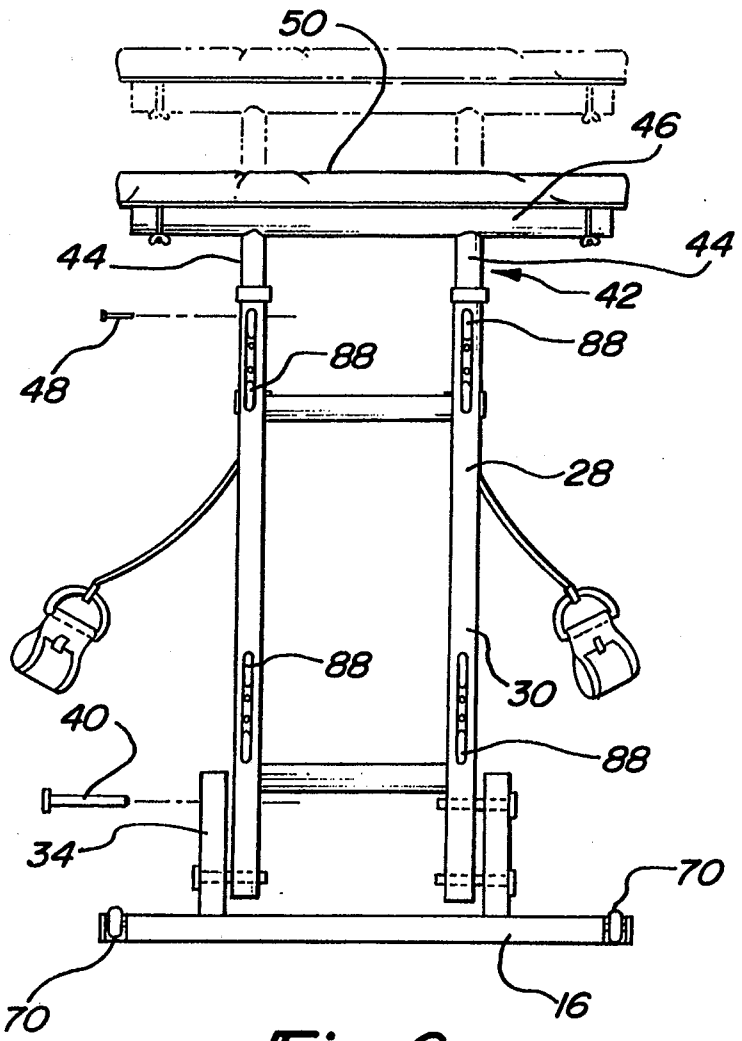
FIG. 6 is a view similar to FIG. 5 but illustrating the opposite end of the preferred embodiment of the present invention.
Figure 7:
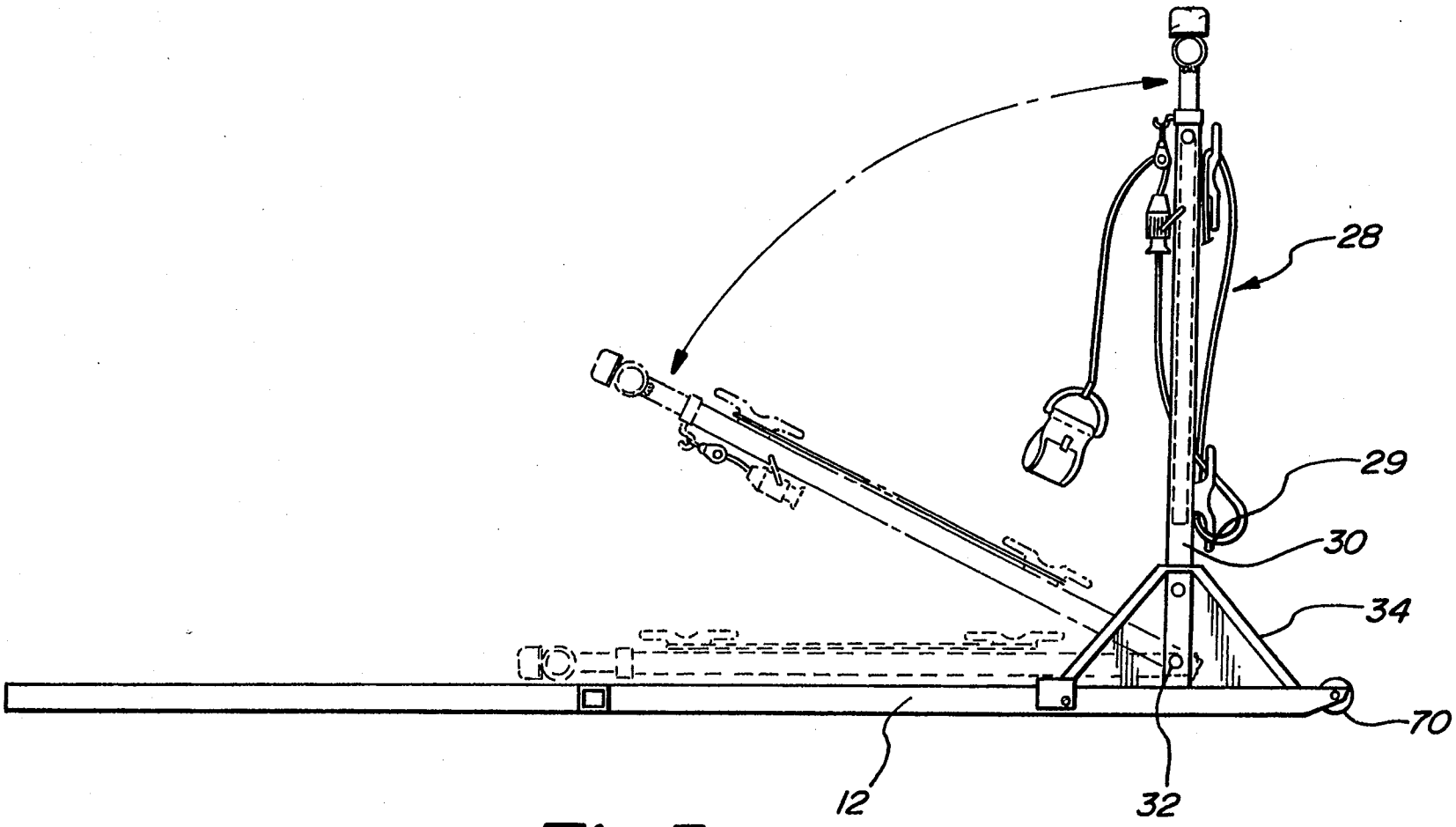
FIG. 7 is a side diagrammatic view illustrating the operation of the present invention.

Referring now to FIGS. 1 and 7, an upright support 28 is secured to the upper surface 22 of the frame 12 adjacent one end 16. The upright support 28 includes a lower section 29 comprising a pair of elongated, spaced apart and parallel tubes 30 which are secured by pivot pins 32 at their lower end to brackets 34 secured to the frame 12 As best shown in FIG. 7, the pivot pin 32 allows the upright support 28 to move between a first vertically extending position, illustrated in solid, and a second collapsed position, illustrated in phantom line, in which the upright support 28 lies fiat along the upper surface of the frame 12 for storage. A locking pin 40 (FIGS. 1 and 6) is removably positioned through registering holes in both the support bracket 34 and lower section 29 of the upright support 28 in order to selectably lock the upright support 28 in its upright position.

With reference now especially to FIG. 6, the upright support 28 includes an upper section 42 having two spaced apart and parallel posts 44 which are secured together by a cross bar 46. The posts 44 of the upper section 42 are telescopically slidably received within the tubes 30 of the lower section 29 of the upright support 28 so that the vertical height of the cross bar 46 can be varied as desired by the user. When the cross bar 46 is in its desired position, the posts 44 are locked to the tubes 30 by removable locking pins 48. Additionally, the cross bar 46 includes a top pad 50 for a reason to be subsequently described.

Figure 5:
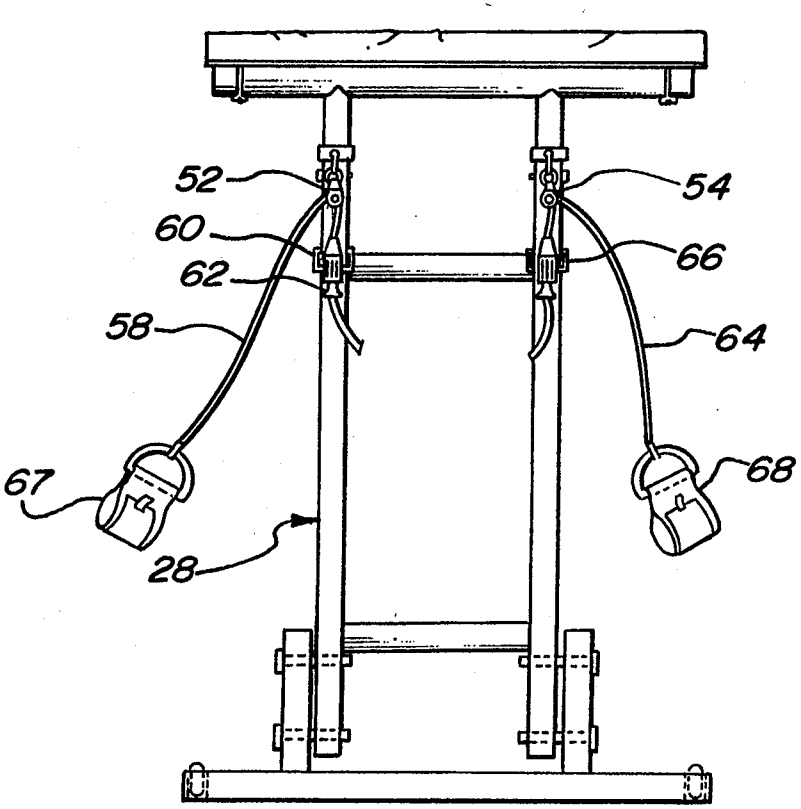
FIG. 5 is an end view of the preferred embodiment of the present invention.

Referring now to FIGS. 1 and 5, a first and second pulley 52 and 54 (FIG. 5) are secured to the upright support 20 adjacent its upper end. An elongated first cord 58 is then threaded through the first pulley 52 and has a cuff 67 attached to one end. The opposite end of the cord 58 is fed through an automatic cord lock 60.

The cord lock 60 is conventional in construction and includes a chuck which is resiliently urged by a spring to its closed position. Thus, the cord 58 can be pulled through the cord lock 60 and, upon release, the cord lock 60 automatically prevents retraction of the cord 57. The cord lock 60, however, includes a release member 62 which, when pulled by the user, releases the cord 58.

A second cord or cord 64 is also threaded or extends through the second pulley 54 and through a second cord lock 66. A cuff 68 is secured to one end of the cord 64 and the cord lock 66 operates in an identical fashion to the cord lack 60 so that a further description thereof is unnecessary.

The wheels 70 protrude outwardly from the end 16 of the frame 12 and are also positioned upwardly from the lower surface 24 of the frame 12. Consequently, the wheels 70 engage the round support surface only when the opposite end 14 of the frame is lifted in order to facilitate movement of the device 10 to storage when not in use.

Figure 8:
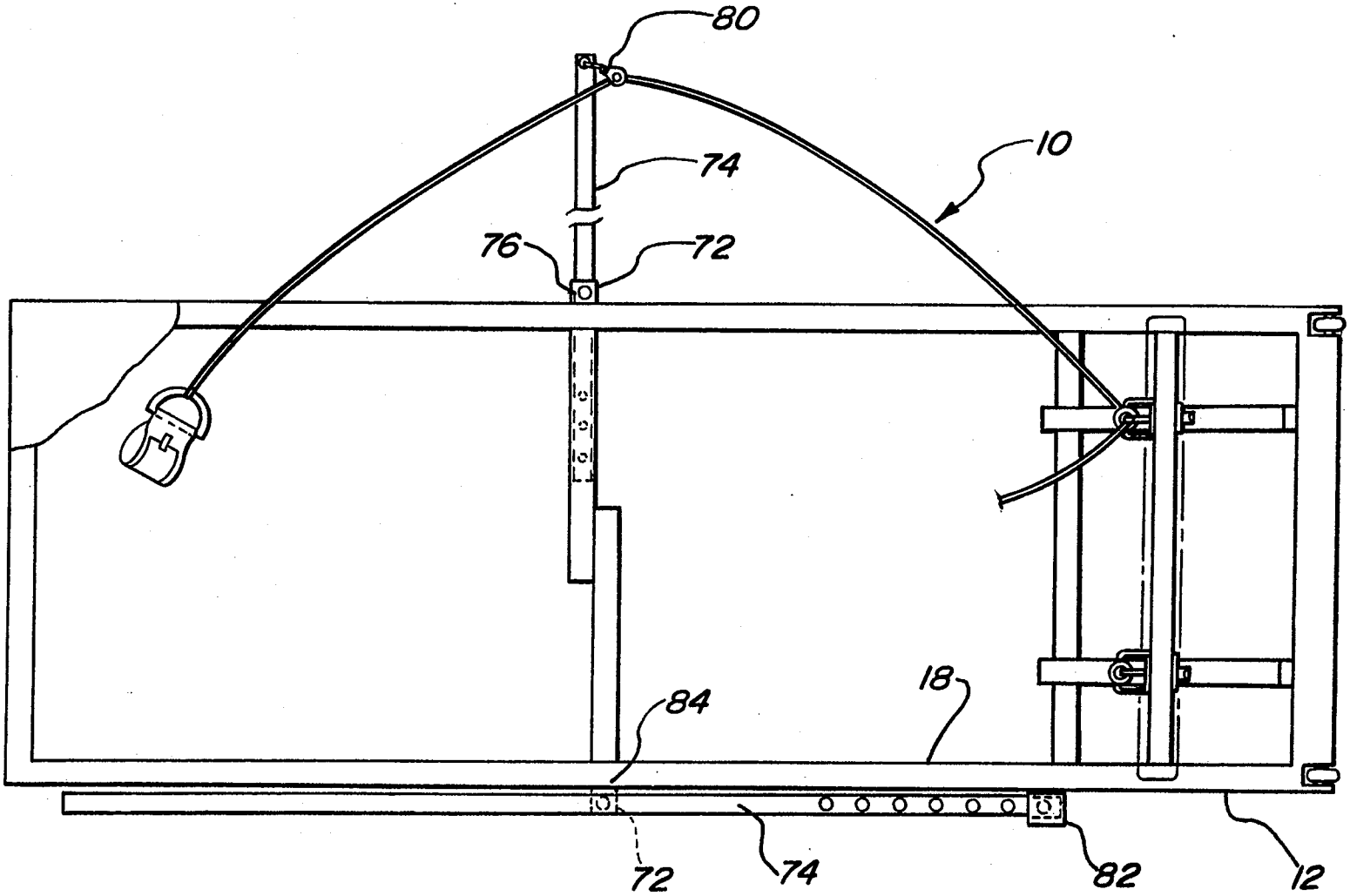
FIG. 8 is a top plan view illustrating the preferred embodiment of the present invention.

With reference now to FIGS. 1 and 8, a socket 72 is secured to each side 18 and 20 of the frame 12. Each socket 72 telescopically receives an elongated lateral support 74 so that the lateral support 74 extend laterally outwardly from the sides 18 and 20 of the frame 12. The lateral supports 74 are secured in a longitudinally adjusted position by a locking pin 76 extending through registering holes in the socket 72 and lateral support 74. Alternatively, the lateral supports 74 can be stored in their associated sockets 72.

A pulley 80 is secured to the outer or distal end of each lateral support 74. Like the pulleys 52 and 54 (FIG. 5) the cords 56 and 64 can alternatively be positioned around the pulleys 80 for different stretching exercises.

The pulleys 80, as well as the pulleys 52 and 54, are preferably slotted pulleys so that the cords 58 and 64 can be rapidly and easily switched between the pulleys 80 to the pulleys 52 and 54. As will be subsequently described, such switching of the cords between the pulleys is desirable for different stretching operations.

With reference especially to FIG. 8, a storage socket 82 is secured to one side 18 of the frame 12. When storage of the device 10 is desired, the lateral supports 74 are removed from the receiving sockets 72 by removing the locking: pin 76 and one end of both lateral support 74 are positioned within the storage socket 82. A locking pin 84 then extends through a second hole in one socket 72 and registering holes in the lateral support 74 in order to secure the lateral support 74 in a position closely adjacent to and parallel to one side 18 of the frame 12.

With reference now to FIG. 1 a raised foot support 86 is also preferably detachably secured to the upper surface of the frame 12. The raised foot support 86 is utilized during certain calf stretching operations.

With reference now to FIGS. 6, a plurality of brackets 88 are preferably secured to the upright support 28. These brackets 88 are utilized to store the cords 56 and 58 when the device 10 is not in use.

Figure 2:
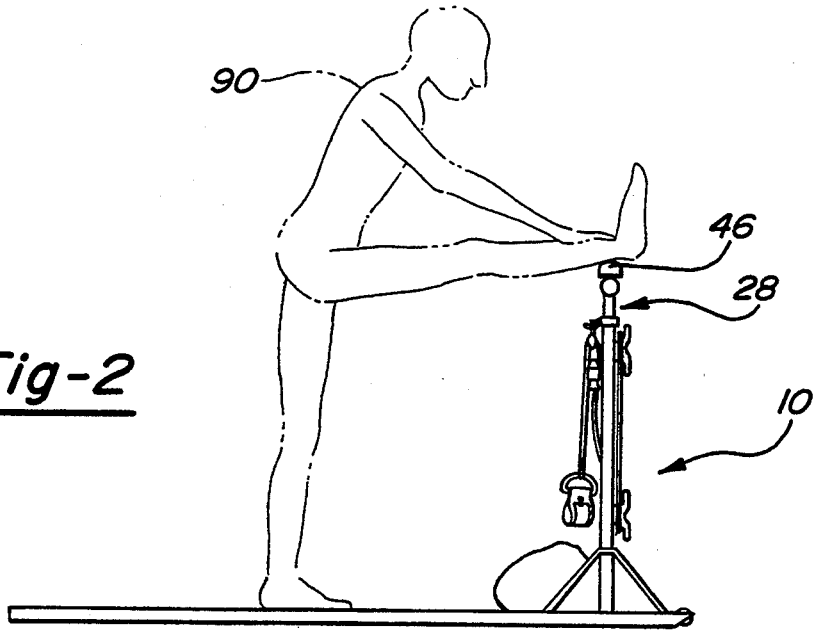
FIG. 2–FIG. 4 are diagrammatic views illustrating the operation of the preferred embodiment of the present invention.
Figure 3:
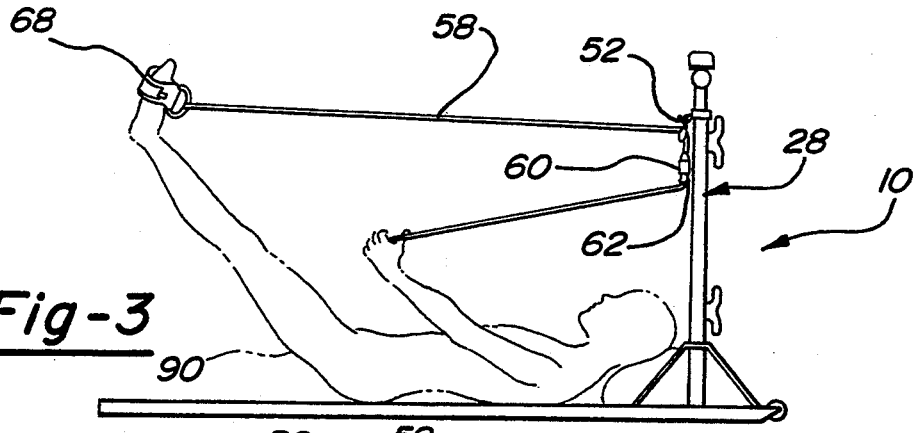
Figure 4:
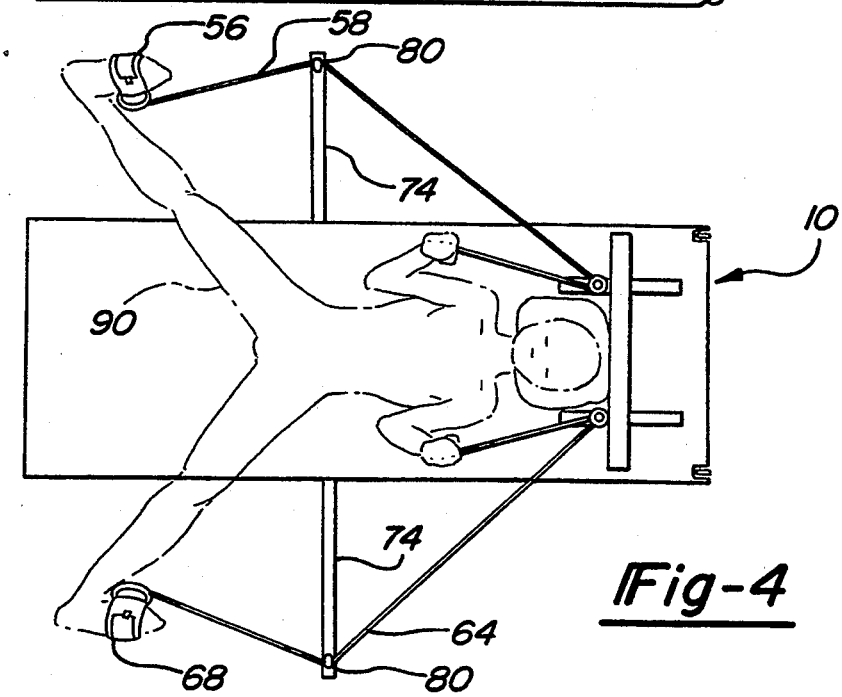

With reference now to FIGS. 2–4, several stretching exercises utilizing the device of the present invention are thereshown. FIG. 2, for example, illustrates the use of the upright support 28 in order to stretch the thigh and groin muscles of the user 90. In this stretch exercise, the user positions his or her foot across the top bar 46 of the upright support 28. Furthermore, since the vertical height of the cross bar 46 is adjustable in the fashion previously described, users of different heights as well as different levels of flexibility can efficiently utilize the device 10.

FIG. 3 illustrates the use of the pulleys 52 and 54 secured to the upright support 28 in order to stretch the users legs. In this stretching exercise, the user lies on his or her back and attaches the cuffs 58 and 68 to the feet. By pulling the cord 56 through the pulley 52 and cord lock 60, the user 90 can easily stretch the legs to the desired position while the cord lock 60 automatically locks the cord 56 in the adjusted position. When the stretching exercise is completed, typically after 10–30 seconds, the user releases the cord 56 by pulling on the chuck release 62.

FIG. 4 illustrates the use of the lateral support 74. In this stretching exercise, the cuffs 68 are positioned on the users feet, the cords 56 and 64 are positioned through the pulleys 80 on the lateral supports 74 and the user 90 lies on his or her back on the top surface of the frame 12. Thereafter, by pulling on the cords 56 and 64, the user 90 stretches his or her legs outwardly in a spread eagle fashion as illustrated in FIG. 4.

FIGS. 2–4 illustrate only a few of the many stretching exercises that can be performed utilizing the device 10 of the present invention. Many different stretching exercises can also be performed using the device of the present invention are changing not only the position of the cords 56 and 64, but also the position of the user on the frame 12.

Figure 9:
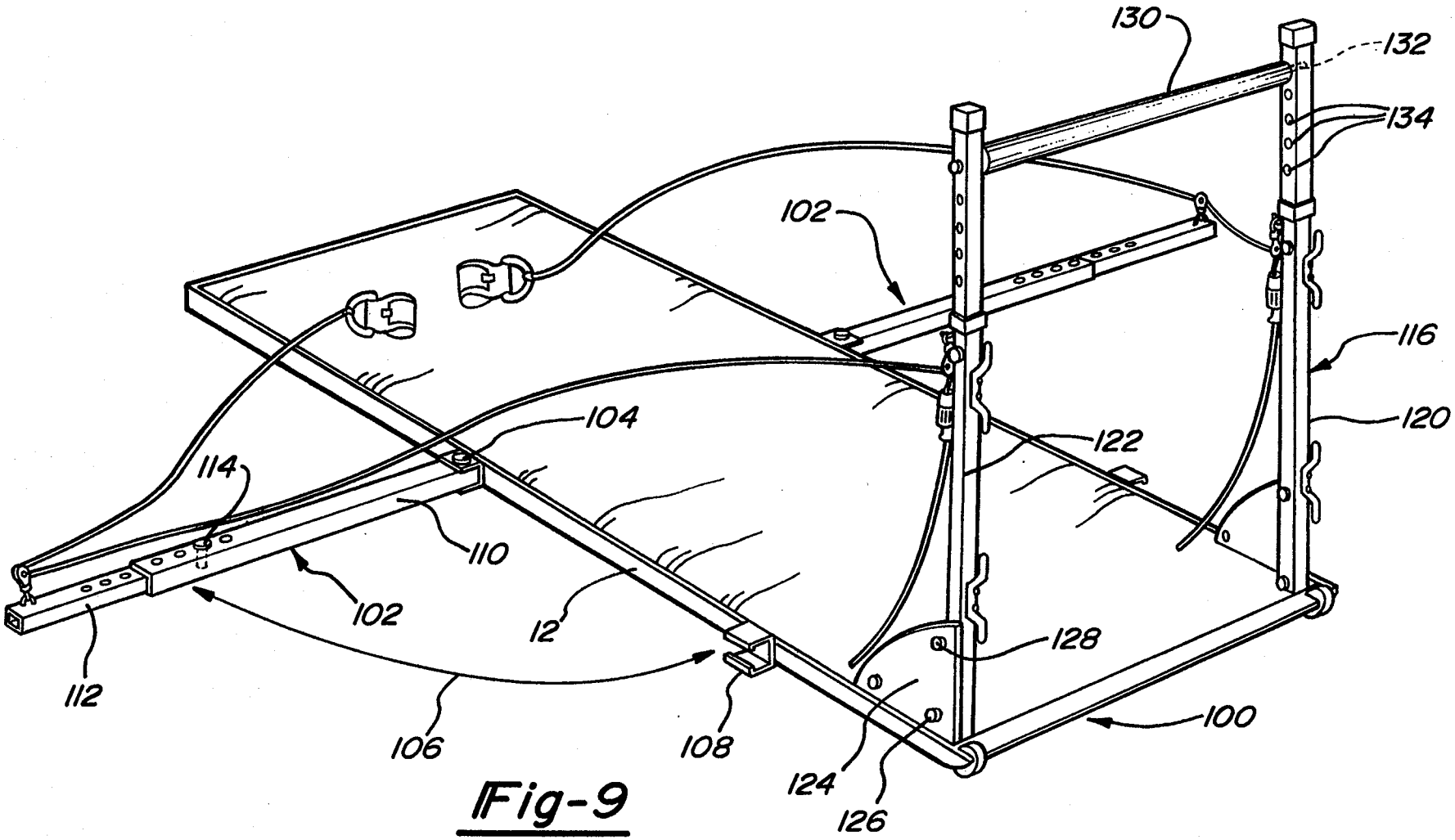
FIG. 9 is an elevational view illustrating a second preferred embodiment of the present invention.

Referring now to FIG. 9, a second preferred embodiment of the stretching apparatus 100 of the present invention is thereshown. The stretching apparatus 100 differs from the stretching apparatus 10 illustrated in FIGS. 1–8 in a number of important respects. First, in the second preferred embodiment, the lateral supports 102 are pivotally secured by a pivot pin 104 to the frame 12. Thus, the lateral supports 102 are movable between an extended in use position, illustrated in solid line in FIG. 9, a collapsed position for storage, as illustrated by the arrow 106. A retaining bracket 108 on the frame 12 releasably locks the lateral supports 102 to the frame 12 when the lateral supports 102 are in their collapsed storage position.

Still referring to FIG. 9, each lateral support 102 also preferably comprises a first section 110 and a second section 112. The first section 110 is pivotally secured to the frame 12 by the pivot pin 104 while the second section 112 is telescopically slidably received within the first section 110. Any conventional means, such as a locking pin 114, is used to secure the lateral support sections 110 and 112 to each other.

A still further difference of the embodiment illustrated in FIG. 9 from the embodiment of the stretching device illustrated in FIGS. 1–8, is that the upright support 116 of the FIG. 9 embodiment preferably comprises two spaced apart struts 120 and 122. Each strut 120 and 122 is pivotally secured to an arcuate mounting plate 124 by a pivot pin 126. In addition, a locking pin 128 locks the struts 120 and 122 to the arcuate mounting plate 124 when the struts 120 and 122 are in an upright position. The same locking pin 128 can also be used to lock the struts 120 and 122 to the frame when the struts 120 and 122 are in their lower collapsed position. A cross bar 130 extends between and is detachably secured to the struts 120 and 122 at a user selected vertical height. Any conventional means, such as a pin 132 on the bar 130 which is selectively positioned in any of the vertically spaced detentes 134 in the struts 120 and 122 can be used to vertically position the cross bar 130.

From the foregoing, it can be seen that the present invention provides a simple, inexpensive and yet highly effective device for performing a plurality of stretching exercise.

Having described my invention, however, many modifications thereto will become apparent to those skilled in the art to which it pertains without deviation from the spirit of the invention as defined by the scope of the appended claims.

We claim:

1. Apparatus for stretching tendons, muscles and associated soft tissue of human joints comprising:

a pulley means, an elongated cord having a first end and a second end, a mid portion of said cord extending around said pulley means, one end of said cord adapted for attachment to a limb of a human, means for automatically locking said cord at a fixed longitudinally adjusted position relative to said pulley means.

2. The invention as defined in claim 1 and comprising a frame, said pulley means being secured to said frame.

3. The invention as defined in claim 1 wherein said frame is generally planar having two sides, two ends, a lower surface adapted to be supported by a ground support surface and an upper surface, an elongated upright support having a first end and a second end, means for securing said first end of said upright support adjacent one end of the frame so that said upright support extends upwardly from the upper surface of the frame, and said pulley means being secured adjacent said second end of said upright support.

4. The invention as defined in claim 3 wherein said securing means comprises means for pivotally securing said upright support to said frame so that said upright support is movable between a first vertically extending position and a second collapsed position in which said upright support lies flat on said upper surface of said frame.

5. The invention as defined in claim 3 wherein said upright support further comprises:

a first elongated section having one end secured to said frame, a second elongated section telescopically received in a second end of said first section, said second section being movable between an extended and a retracted position, and means for locking said first and second sections together at an adjusted position between said extended and retracted positions.

6. The invention as defined in claim 5 wherein said second section includes a plurality of spaced holes and wherein said locking means comprises a locking pin extending between a hole in said first section and one of said spaced holes in said second section.

7. The invention as defined in claim 3 and comprising a second pulley means secured adjacent said second end of said upright support and an elongated second cord having one end adapted to be secured to a limb of the human user, said second cord extending through said second pulley means.

8. The invention as defined in claim 3 and comprising means for releasably locking said cord at an adjusted position relative to said pulley means at a user selected position.

9. The invention as defined in claim 8 wherein said locking means comprises a chuck through which said cord extends, means for resiliently urging said chuck towards a closed position to thereby lock said chuck to said cord, user actuated means for moving said chuck to an open position to thereby release said cord and means for securing said chuck to said upright support.

10. The invention as defined in claim 3 and comprising an elongated lateral support having two ends, means for securing one end of said lateral support to one side of said frame so that said lateral support extends laterally outwardly from one side of said frame, and a second pulley secured adjacent said other end of said lateral support, said cord adapted to extend through said second pulley.

11. The invention as defined in claim 10 and comprising a second elongated lateral support having two ends, means for securing one end of said second lateral support to the other side of said frame so that said second lateral support extends laterally outwardly from said other side of said frame, and a third pulley means secured adjacent said other end of said second lateral support, a second cord adapted to extend through said third pulley.

12. The invention as defined in claim 10 wherein said means for securing said lateral support to said frame comprises means for detachable securing said lateral support to said frame.

13. The invention as defined in claim 12 wherein said one side of said frame includes a socket adapted to receive said one end of said lateral support, said socket having a hole, wherein said one end of said lateral support includes a hole adapted to register with said hole in said socket, and wherein detachable securing means comprises a pin removably insertable through said registering holes in said socket and said lateral support.

14. The invention as defined in claim 3 and comprising a pair of wheels secured to one end of said frame, said wheels engaging the ground support surface only when the opposite end of the frame is elevated with respect to the first end of the frame.

15. The invention as defined in claim 10 wherein said means for securing said lateral support to said frame comprises means for pivotally securing said lateral support to said frame.

16. The invention as defined in claim 10 wherein said lateral support comprises a first section and a second section, said second section being telescopically received in said first section, and means for locking said lateral support sections together.

* * * * *